US007586267B2

(12) United States Patent
Po

(10) Patent No.: US 7,586,267 B2
(45) Date of Patent: Sep. 8, 2009

(54) INVERTER SYSTEM AND DETECTING DEVICE THEREOF

(75) Inventor: Tai-Sheng Po, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 303 days.

(21) Appl. No.: 11/640,192

(22) Filed: Dec. 18, 2006

(65) Prior Publication Data

US 2007/0152609 A1 Jul. 5, 2007

(30) Foreign Application Priority Data

Jan. 3, 2006 (TW) ..... 95100200 A

(51) Int. Cl.
*H05B 37/00* (2006.01)

(52) U.S. Cl. ..... 315/224; 315/225; 315/226.308

(58) Field of Classification Search ..... 315/307, 315/308, 224, 225, 226
See application file for complete search history.

(56) References Cited

U.S. PATENT DOCUMENTS 5,930,126 A * 7/1999 Griffin et al. ..... 363/37
2002/0181260 A1* 12/2002 Chou et al. ..... 363/95

* cited by examiner

*Primary Examiner*—David Hung Vu
(74) *Attorney, Agent, or Firm*—Birch, Stewart, Kolasch & Birch, LLP

(57) ABSTRACT

A detecting device of an inverter system comprises at least one detecting element and at least one comparative unit. The detecting element is electrically connected to any one of the connecting parts of the inverter system to get a voltage signal. The comparative unit generates a control signal to shut the inverter system down when the voltage signal is higher than a reference signal.

20 Claims, 3 Drawing Sheets

INVERTER SYSTEM AND DETECTING DEVICE THEREOF

DETAILED DESCRIPTION OF THE INVENTION

Cross Reference to Related Applications

This Non-provisional application claims priority under 35 U.S.C. §119(a) on Patent Application No(s). 095100200 filed in Taiwan, Republic of China on Jan. 3, 2006, the entire contents of which are hereby incorporated by reference.

BACKGROUND OF THE INVENTION

1. Field of Invention

The invention relates to an inverter system and a detecting device thereof, and, in particular, to an inverter system and a detecting device thereof capable of detecting spark phenomena.

2. Related Art

A cold cathode fluorescent lamp (CCFL) has been widely used in various electronic products to serve as a light source or a backlight source. An inverter system boosts a low voltage to a high voltage equal to several hundreds to several thousands of volts for the CCFL.

Because the inverter system is a high voltage circuit, high voltage sparks tend to occur, thereby causing the user to be dangerously shocked or the elements to burn out. Thus, the conventional inverter system has an open-circuit protection circuit and a short-circuit protection circuit for the CCFL to ensure that the inverter system can shut the output of the high voltage down when the CCFL fails and thus prevent the whole circuit from being damaged accordingly. The conventional inverter system only can detect whether the CCFL fails but cannot detect the abnormal condition when the CCFL works normally but the other elements or circuits become abnormal (e.g., when the high-voltage spark occurs) and thus fails to shut the output of the high voltage down in such abnormal conditions. Thus, the user still may be shocked or the elements may burn out.

In view of the above-mentioned problems, a spark protection circuit has been disclosed in, for example, U.S. Patent Publication No. 2004/0012381, in which a wire abuts against a high-voltage loop of an inverter system. Sensing a magnetic flux change in the high-voltage loop can induce a voltage change of the inverter system and thus detect when a spark phenomenon occurs. However, the above-mentioned method needs to additionally add wires and cores, and the overall interconnection complexity and the number of elements are increased. In addition, the dimension of the wire and the distance between the wire and the high-voltage loop cannot be easily controlled. As a result, the magnetic flux change may be not precise enough, thereby influencing the detection result.

Thus, it is an important subject of the invention to provide an inverter system and a detecting device thereof capable of precisely detecting spark phenomena.

SUMMARY OF THE INVENTION

In view of the foregoing, the invention is to provide an inverter system and a detecting device thereof capable of precisely detecting spark phenomena.

To achieve the above, the invention discloses a detecting device of an inverter system comprising at least one detecting element and at least one comparing unit. The detecting element is electrically connected to one of connecting parts of the inverter system to obtain a voltage signal from the connecting part. The comparing unit generates and outputs a control signal to the inverter system to shut the inverter system down when the voltage signal is higher than a reference signal.

To achieve the above, the invention also discloses an inverter system to be coupled to a load. The inverter system comprises an inverter device and a detecting device. The inverter device generates and outputs an AC signal to the load. The detecting device has at least one detecting element and at least one comparing unit. The detecting element is electrically connected to any one of connecting parts of the inverter device to obtain a voltage signal from the connecting part. The comparing unit generates and outputs a control signal to the inverter device to shut the inverter device down when the voltage signal is higher than a reference signal.

As mentioned above, the detecting element is used to detect spark phenomena of the inverter system according to the inverter system and the detecting device of the invention, and the inverter system is shut down to protect the inverter system when spark phenomena occur. Compared with the prior art, the invention performs the detection by enabling the detecting element to obtain the voltage signal of the inverter system directly without additional core elements, and thus has the advantages of higher precision and fewer elements.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
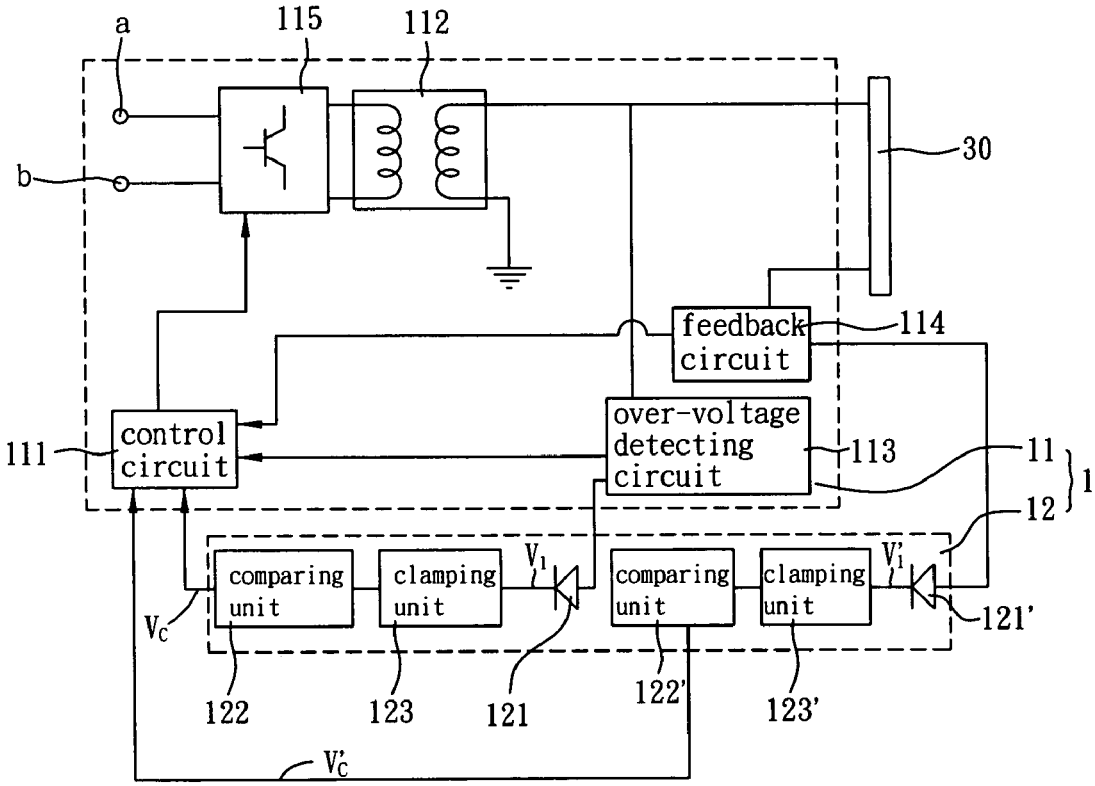
FIG. 1 is a schematic illustration showing an inverter system according to a preferred embodiment of the invention.
Figure 2:
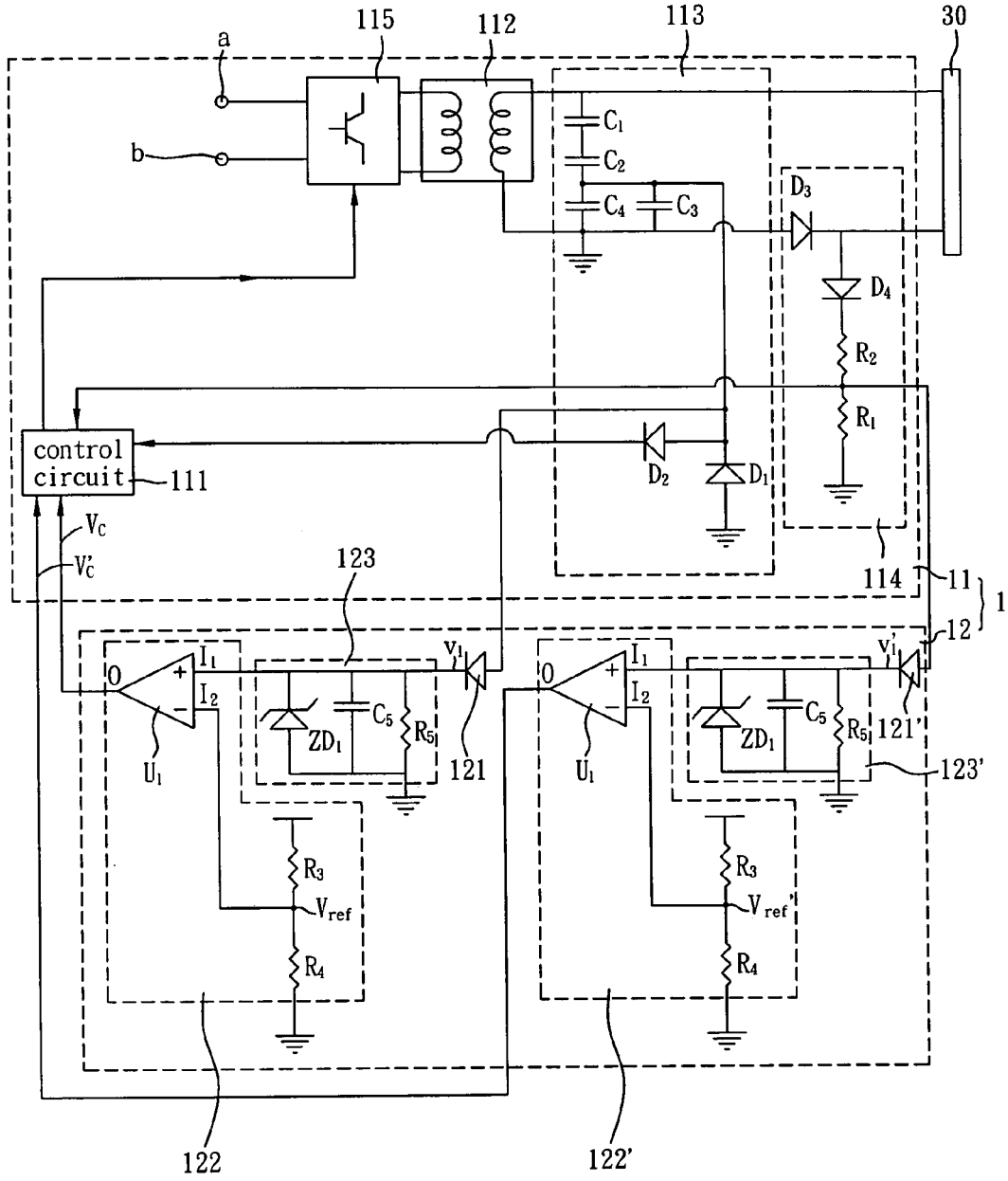
FIG. 2 is a circuit diagram showing the inverter system according to the preferred embodiment of the invention.

FIGS. 1 and 2 are respectively a schematic illustration and a circuit diagram showing an inverter system 1 according to a preferred embodiment of the invention. The inverter system 1 comprises an inverter device 11 and a detecting device 12.

As shown in FIG. 1, the inverter device 11 comprises a set of DC input connection points a and b, a control circuit 111, a voltage converting unit 112, an over-voltage detecting circuit 113, a feedback circuit 114 and a switch 115.

The DC input connection points a and b, which are connected to an external DC power source (not shown), receive a DC input supplied from a DC power source, which comprises, without limitation, a battery or an AC-DC converter.

The control circuit 111 for controlling operations of the inverter system 1 comprises a drive circuit, a switch controller, and an inverter, which can be a push-pull inverter, a half-bridge inverter, a full-bridge inverter or a self-excited inverter. The control circuit 111 may be a control chip.

The voltage converting unit 112 comprises a transformer having a primary side coil part and a secondary side coil part. The primary side coil part receives the DC input. The secondary side coil part outputs an AC output to at least one load 30 (e.g., CCFL) to power the operation of load 30.

The over-voltage detecting circuit 113, electrically connected to the secondary side coil part, detects the AC output of the secondary side coil part and outputs the AC output to the control circuit 111 to judge whether the AC output is too great.

As shown in FIG. 2, the over-voltage detecting circuit 113 of this embodiment comprises a plurality of capacitors $C_1$ to $C_4$ and a plurality of diodes $D_1$ and $D_2$. The capacitor $C_1$ and the capacitor $C_2$ are connected in series. The capacitor $C_3$ and the capacitor $C_4$ are connected in parallel. One end of the capacitor $C_2$ is electrically connected to one end of each of the capacitors $C_3$ and $C_4$. The voltage of the AC output of the secondary side coil part may be divided by the capacitors $C_1$ to $C_4$ to facilitate the processing of the control circuit 111. The cathode of the diode $D_1$ is electrically connected to the ends of the capacitors $C_3$ and $C_4$. The anode of the diode $D_2$ is electrically connected to the ends of the capacitors $C_3$ and $C_4$ to prevent a backward voltage.

The feedback circuit 114 electrically connected to the load 30 feeds the voltage of the load 30 back to the control circuit 111 to facilitate the subsequent operation. The feedback circuit 114 of this embodiment comprises a plurality of diodes $D_3$ and $D_4$ and a plurality of resistors $R_1$ and $R_2$. The anode of the diode $D_3$ is electrically connected to the other end of the each of the capacitors $C_3$ and $C_4$. The anode of the diode $D_4$ is electrically connected to the cathode of the diode $D_3$. The resistors $R_1$ and $R_2$ are connected in series to divide the voltage of the load 30 and thus to facilitate the processing of the control circuit 111.

The switch 115 is used to cut off the DC power supplied to the circuit of the DC input connection points a and b. The control circuit 111 controls the switch 115 to cut off the power supply of the DC power according to a control signal $V_c$ so as to shut the inverter device 11 down.

Referring again to FIG. 1, the detecting device 12 of this embodiment comprises at least one detecting element and at least one comparing unit. In this embodiment, the detecting device 12 comprises two detecting elements 121 and 121' and two comparing units 122 and 122'. The number of each of the detecting elements and the comparing units may be adjusted according to the actual requirement.

The detecting elements 121 and 121' can be a Schottky diode, which is suitable for a high-frequency and high-speed switching circuit. The detecting elements 121 and 121' are electrically connected to any one of connecting parts of the inverter device 11 to obtain voltage signals $V_1$ and $V_1'$ of the connecting parts for detection. The detecting elements 121 and 121' of this embodiment are electrically connected, without limitation, to the over-voltage detecting circuit 113 and the feedback circuit 114, respectively, to obtain the voltage signals $V_1$ and $V_1'$ of the corresponding connecting parts. The detecting elements 121 and 121' may also be electrically connected to other connecting parts of the inverter device 11 to obtain the voltage signals of different connecting parts. In this embodiment, the inverter system 1 simultaneously has the two detecting elements 121 and 121' and the two comparing units 122 and 122', and is electrically connected to the over-voltage detecting circuit 113 and the feedback circuit 114, respectively. It is to be noted that the embodiment is not limited thereto, and the inverter system 1 may also have only one detecting element and one comparing unit.

Referring to FIG. 2, the comparing units 122 and 122' respectively comprise a comparator $U_1$ and a voltage dividing circuit, which has two resistors $R_3$ and $R_4$ connected in series.

In the comparing unit 122, the comparator $U_1$ has a first input terminal $I_1$, a second input terminal $I_2$ and an output terminal O. The first input terminal $I_1$ of this embodiment is a noninverting input terminal, and the second input terminal $I_2$ is an inverting input terminal. The first input terminal $I_1$ receives a voltage signal $V_1$. The voltage dividing circuit composed of the resistors $R_3$ and $R_4$ connected in series can generate a reference signal $V_{ref}$, and the second input terminal $I_2$ receives the reference signal $V_{ref}$.

In the comparing unit 122', the first input terminal $I_1$ receives a voltage signal $V_1'$. The voltage dividing circuit composed of the resistors $R_3$ and $R_4$ connected in series may generate a reference signal $V_{ref}'$, and the second input terminal $I_2$ receives the reference signal $V_{ref}'$.

In this embodiment, the reference signals $V_{ref}$ and $V_{ref}'$ are reference voltage levels according to which the spark phenomenon is judged, and the reference signals $V_{ref}$ and $V_{ref}'$ can be selected according to the actual requirement. Adjusting the resistance values of the resistors $R_3$ and $R_4$ of the comparing units 122 and 122' may adjust the values of the reference signals $V_{ref}$ and $V_{ref}'$.

Two comparators $U_1$ compare the voltage signals $V_1$, $V_1'$ with the reference signals $V_{ref}$, $V_{ref}'$, respectively. When the voltage signal $V_1$ is greater than the reference signal $V_{ref}$ and/or the voltage signal $V_1'$ is greater than the reference signal $V_{ref}'$, the output terminal O outputs a control signal $V_c$ and/or $V_c'$ to the control circuit 111 to enable the switch 115 to cut off the power supply of the DC power and to shut the inverter device 11 down. Thus, the object of spark detection may be achieved, the element damage can be avoided, and the resultant safety and device protection can be achieved.

Figure 3A:
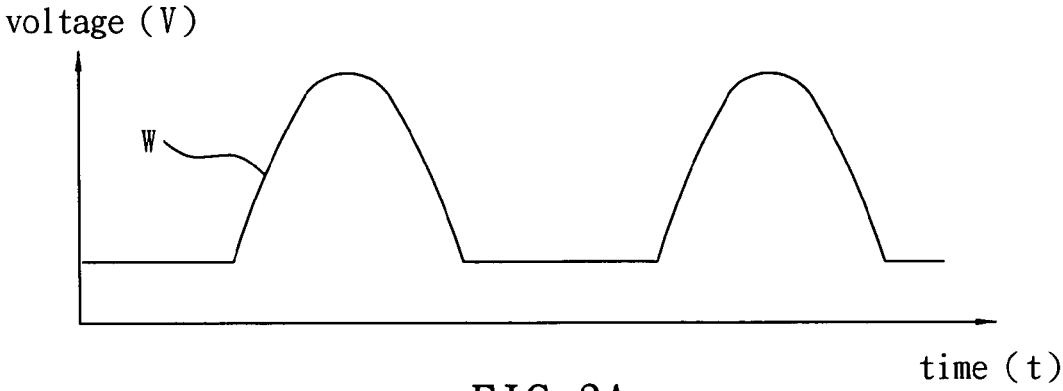
FIG. 3A shows a waveform of an AC output when the inverter system according to the preferred embodiment of the invention works normally.
Figure 3B:
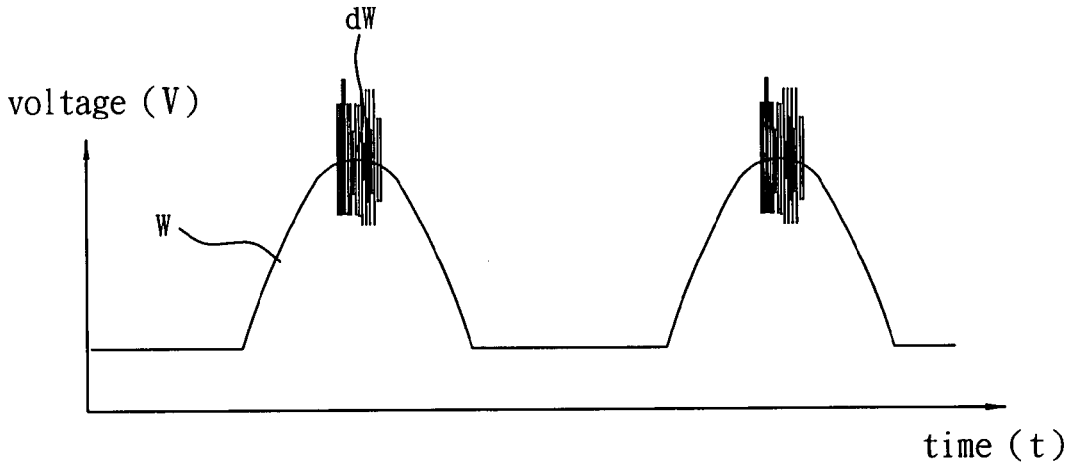
FIG. 3B shows a waveform of the AC output when the inverter system according to the preferred embodiment of the invention generates a spark.
Figure 3C:
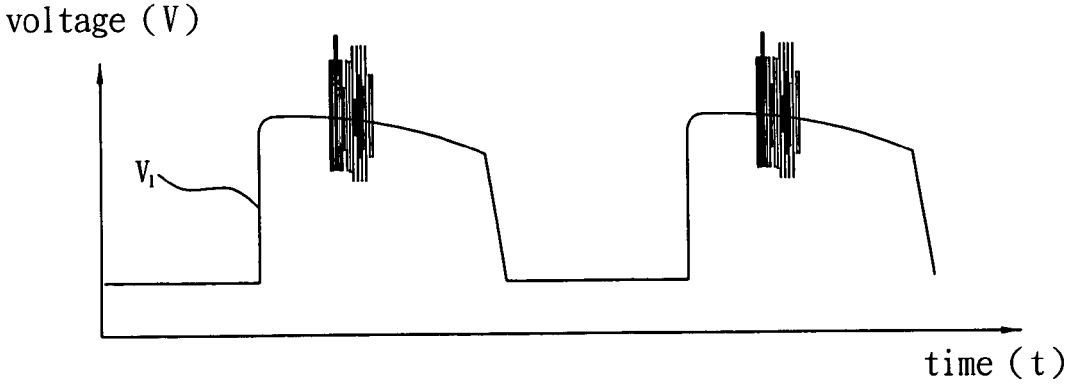
FIG. 3C shows a waveform of a voltage signal of the inverter system according to the preferred embodiment of the invention.

As shown in FIGS. 3A to 3C, in order to make the invention more easily understood, illustrations will be made respectively, according to waveforms of AC outputs under normal conditions, spark conditions, and the waveform of the voltage signal detected by the detecting element 121. When the inverter system 1 works normally, the waveform of the AC output of the over-voltage detecting circuit 113 is a half-wave waveform W, as shown in FIG. 3A. However, when spark phenomena occurs, the waveform of the AC output is an abnormal waveform, as shown in FIG. 3B. The abnormal waveform is formed by the half-wave waveform W in conjunction with a surge dW. At this time, the detecting element 121 may obtain the voltage signal $V_1$, as shown in FIG. 3C, and the detecting element 121 rectifies the voltage signal $V_1$ and outputs the rectified signal to the comparing unit 122. Then, the comparator $U_1$ compares the voltage signal $V_1$ with the reference signal $V_{ref}$. When the voltage signal $V_1$ is greater than the reference signal $V_{ref}$, the output terminal O outputs the control signal $V_c$ to the control circuit 111 to enable the switch 115 to cut off the power supply of the DC power and to shut the inverter device 11 down. Thus, the object of spark detection may be achieved, the element damage can be avoided, and the resultant safety and device protection can be achieved.

Referring again to FIG. 1, the detecting device 12 of this embodiment may further comprise two clamping units 123 and 123', which are respectively disposed between the detecting element 121 and the comparing unit 122 and between the detecting element 121' and the comparing unit 122'. The clamping unit 123 is electrically connected to the detecting element 121 and the comparing unit 122, while the clamping unit 123' is electrically connected to the detecting element 121' and the comparing unit 122'. The clamping units 123 and 123' respectively process the voltage signals $V_1$ and $V_1'$ to adjust the levels of the voltage signals $V_1$ and $V_1'$ and thus to facilitate the comparison of the comparator $U_1$. As shown in FIG. 2, each of the clamping units 123 and 123' comprises a resistor $R_5$, a capacitor $C_5$ and a diode $ZD_1$.

A first terminal of the resistor $R_5$, a first terminal of the capacitor $C_5$ and a first terminal of the diode $ZD_1$ are electrically connected to one another and further electrically connected to the detecting element 121 and the first input terminal $I_1$. A second terminal of the resistor $R_5$, a second terminal of the capacitor $C_5$, and a second terminal of the diode $ZD_1$ are electrically connected to one another and are grounded to form the clamping units 123 and 123'.

In addition, the invention also discloses a detecting device, which is the same as the detecting device 12 according to the above-mentioned embodiment, and detailed descriptions thereof will be omitted.

In summary, the detecting element is used to detect the spark phenomenon of the inverter system according to the inverter system and the detecting device of the invention, and the inverter system is shut down to protect the inverter system when spark phenomena occur. Compared with the prior art, the invention performs the detection by enabling the detecting element to obtain the voltage signal of the inverter system directly without additional core elements, and thus has the advantage of higher precision and fewer elements.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An inverter system coupled to a load, comprising:

an inverter device for generating and outputting an AC signal to the load; and a detecting device having at least one detecting element and at least one comparing unit, wherein the detecting element is electrically connected to one of connecting parts of the inverter device to obtain a voltage signal from the connecting part, and the comparing unit generates and outputs a control signal to the inverter device to shut the inverter device down when the voltage signal is relatively higher than a reference signal which is a reference voltage level according to which a spark phenomenon is judged.

2. The inverter system according to claim 1, wherein the detecting element is a Schottky diode.

3. The inverter system according to claim 1, wherein the load is a cold cathode fluorescent lamp (CCFL).

4. The inverter system according to claim 1, wherein the comparing unit comprises a comparator having a first input terminal for receiving the voltage signal, a second input terminal for receiving the reference signal, and an output terminal for outputting the control signal.

5. The inverter system according to claim 4, wherein the second input terminal of the comparator is electrically connected to a voltage dividing circuit, and the voltage dividing circuit generates the reference signal.

6. The inverter system according to claim 1, wherein the detecting device further comprises a clamping unit electrically connected to the detecting element and the comparing unit to adjust a level of the voltage signal.

7. The inverter system according to claim 6, wherein the clamping unit comprises a resistor, a capacitor and a diode; a first terminal of the resistor, a first terminal of the capacitor, and a first terminal of the diode are electrically connected to one another and further electrically connected to the detecting element and the comparing unit; and a second terminal of the resistor, a second terminal of the capacitor, and a second terminal of the diode are electrically connected to one another.

8. The inverter system according to claim 1, wherein the inverter device comprises an over-voltage detecting circuit, and the detecting element is electrically connected to one of connecting parts of the over-voltage detecting circuit.

9. The inverter system according to claim 1, wherein the inverter device comprises a feedback circuit, and the detecting element is electrically connected to one of connecting parts of the feedback circuit.

10. The inverter system according to claim 1, wherein the inverter device comprises a control circuit for receiving the control signal and shutting the inverter system down according to the control signal.

11. The inverter system according to claim 10, wherein the control circuit comprises an inverter, a drive circuit and a switch controller.

12. The inverter system according to claim 11, wherein the inverter is a push-pull inverter, a half-bridge inverter, a full-bridge inverter or a self-excited inverter.

13. The inverter system according to claim 10, wherein the inverter device comprises a switch, and the control circuit controls the switch to cut off a power supply of a DC power according to the control signal so as to shut the inverter device down.

14. The inverter system according to claim 1, wherein the inverter device comprises a voltage converting unit or a transformer, and the detecting element or the transformer is electrically connected to one of connecting parts of the voltage converting unit or the transformer to obtain the voltage signal.

15. A detecting device of an inverter system, comprising:

at least one detecting element electrically connected to one of connecting parts of the inverter system to receive a voltage signal from the connecting part; and at least one comparing unit for generating and outputting a control signal to the inverter system to shut the inverter system down when the voltage signal is relatively higher than a reference signal which is a reference voltage level according to which a spark phenomenon is judged.

16. The detecting device according to claim 15, wherein the detecting element is a Schottky diode.

17. The detecting device according to claim 15, wherein the comparing unit comprises a comparator having a first input terminal for receiving the voltage signal, a second input terminal for receiving the reference signal, and an output terminal for outputting the control signal.

18. The detecting device according to claim 17, wherein the second input terminal of the comparator is electrically connected to a voltage dividing circuit, and the voltage dividing circuit generates the reference signal.

19. The detecting device according to claim 15, further comprising a clamping unit electrically connected to the detecting element and the comparing unit to adjust a level of the voltage signal.

20. The detecting device according to claim 19, wherein the clamping unit comprises a resistor, a capacitor and a diode; a first terminal of the resistor, a first terminal of the capacitor, and a first terminal of the diode are electrically connected to one another and further electrically connected to the detecting element and the comparing unit; and a second terminal of the resistor, a second terminal of the capacitor, and a second terminal of the diode are electrically connected to one another.

* * * * *